US011230399B2

(12) United States Patent
Overhuijs et al.

(10) Patent No.: US 11,230,399 B2
(45) **Date of Patent: *Jan. 25, 2022**

(54) STICK FILLER PIPE WITH INTEGRAL STERILIZATION

(71) Applicant: JBT Food & Dairy Systems B.V., Amsterdam (NL)

(72) Inventors: Rudy Jan Overhuijs, Oostzaan (NL); Marijn Luijten, Haarlem (NL)

(73) Assignee: JBT Food & Dairy Systems B.V., Amsterdam (NL)

( * ) Notice: Subject to any disclaimer, the term of this patent is extended or adjusted under 35 U.S.C. 154(b) by 187 days.

This patent is subject to a terminal disclaimer.

(21) Appl. No.: 16/597,562

(22) Filed: Oct. 9, 2019

(65) Prior Publication Data

US 2020/0140133 A1 May 7, 2020

(30) Foreign Application Priority Data

Oct. 10, 2018 (NL) ..... 2021787

(51) Int. Cl.
*B65B 55/10* (2006.01)
*B65B 55/02* (2006.01)

(52) U.S. Cl.
CPC ..... *B65B 55/103* (2013.01); *B65B 55/027* (2013.01)

(58) Field of Classification Search
CPC ..... B65B 55/02; B65B 55/103; B65B 55/027; B65B 9/213
See application file for complete search history.

(56) References Cited

U.S. PATENT DOCUMENTS 2,160,367 A * 5/1939 Maxfield ..... B65B 31/045 53/433
3,269,079 A * 8/1966 Schmied ..... B65B 55/06 53/426
3,470,672 A * 10/1969 Tuma ..... B65B 3/26 53/493
3,850,207 A * 11/1974 Loliger ..... B65B 55/103 141/90

(Continued)

FOREIGN PATENT DOCUMENTS

WO 2017/220688 A1 12/2017

OTHER PUBLICATIONS

Search Report and Written Opinion dated Jul. 9, 2019, issued in corresponding NL Application No. 2021787 filed Oct. 10, 2018, 8 pages.

*Primary Examiner* — Thomas M Wittenschlaeger
(74) *Attorney, Agent, or Firm* — Christensen O'Connor Johnson Kindness PLLC

(57) ABSTRACT

A sterilizer-filler nozzle assembly for an aseptic packaging machine comprises a form section 40, a product supply duct that has a product outlet portion 4 which lies downstream of a distal end of the form section 40, a sterilization medium supply duct that has a sterilization medium outlet portion 16 which lies between the distal end of the form section 40 and the product outlet portion 4, and an exhaust duct that has an exhaust inlet portion 22 which lies between the distal end of the form section 40 and the product outlet portion 4. A gas supply duct is provided that has a gas outlet portion 10 which lies between the sterilization medium outlet portion 16 and the product outlet portion 4.

19 Claims, 8 Drawing Sheets

(56) References Cited

U.S. PATENT DOCUMENTS

| | | | | | |
|---|---|---|---|---|---|
| 3,854,874 | A * | 12/1974 | Loliger | B65B 55/103 | 422/299 |
| 3,911,642 | A * | 10/1975 | Ernstsson | B65B 55/06 | 53/426 |
| 4,055,035 | A * | 10/1977 | Sjostrand | B65B 55/103 | 53/167 |
| 4,606,174 | A * | 8/1986 | Berg | B65B 9/2049 | 53/451 |
| 4,617,779 | A * | 10/1986 | Nygren | B65B 9/2049 | 53/433 |
| 4,731,980 | A * | 3/1988 | Worden | B29C 65/3668 | 53/551 |
| 4,784,697 | A * | 11/1988 | Bordini | B67C 3/002 | 134/22.15 |
| 7,958,697 | B2 * | 6/2011 | Rapparini | B65B 55/106 | 53/425 |
| 2003/0177739 | A1 * | 9/2003 | Lewis, Jr. | B65B 9/20 | 53/425 |
| 2019/0217983 | A1 * | 7/2019 | Newman | B65B 3/02 | |
| 2020/0115086 | A1 * | 4/2020 | Tervoort | B65B 9/06 | |

* cited by examiner

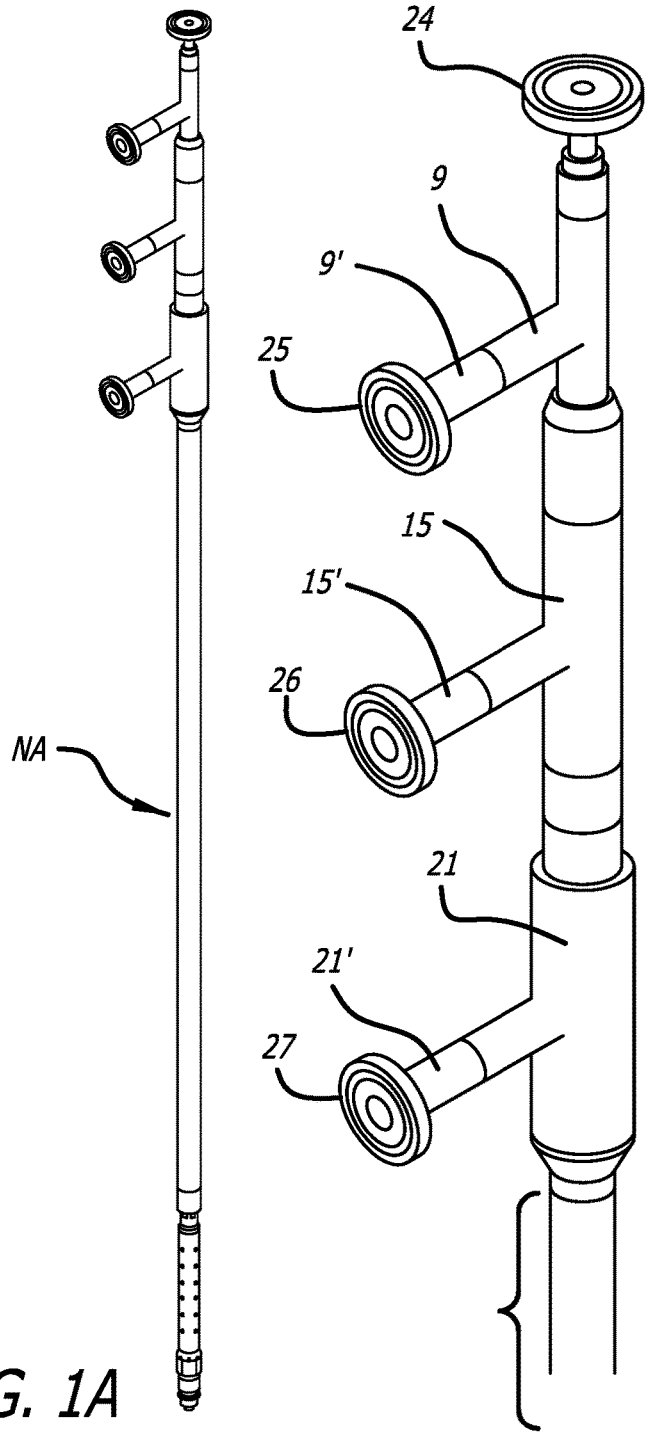
FIG. 1C
24
9
9'
25
15
15'
26
NA
21
21'
27
FIG. 1A
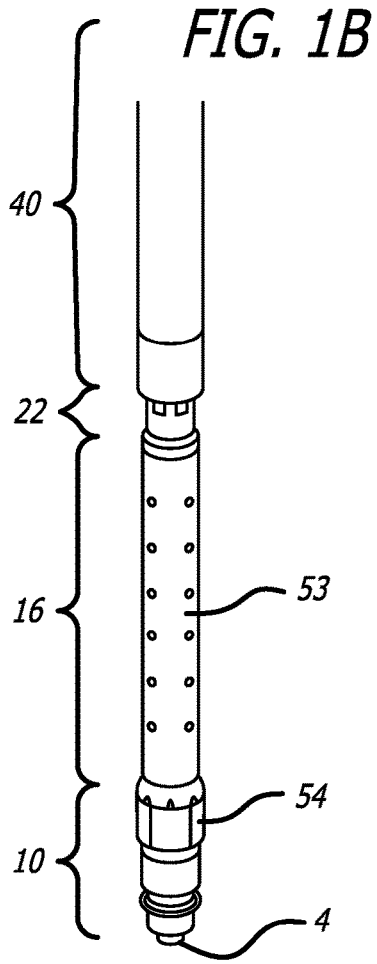
FIG. 1B
40
22
16
53
54
10
4

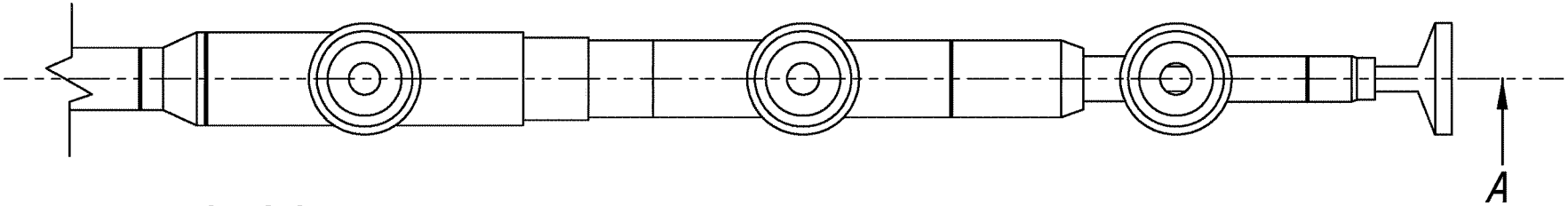
FIG. 2C
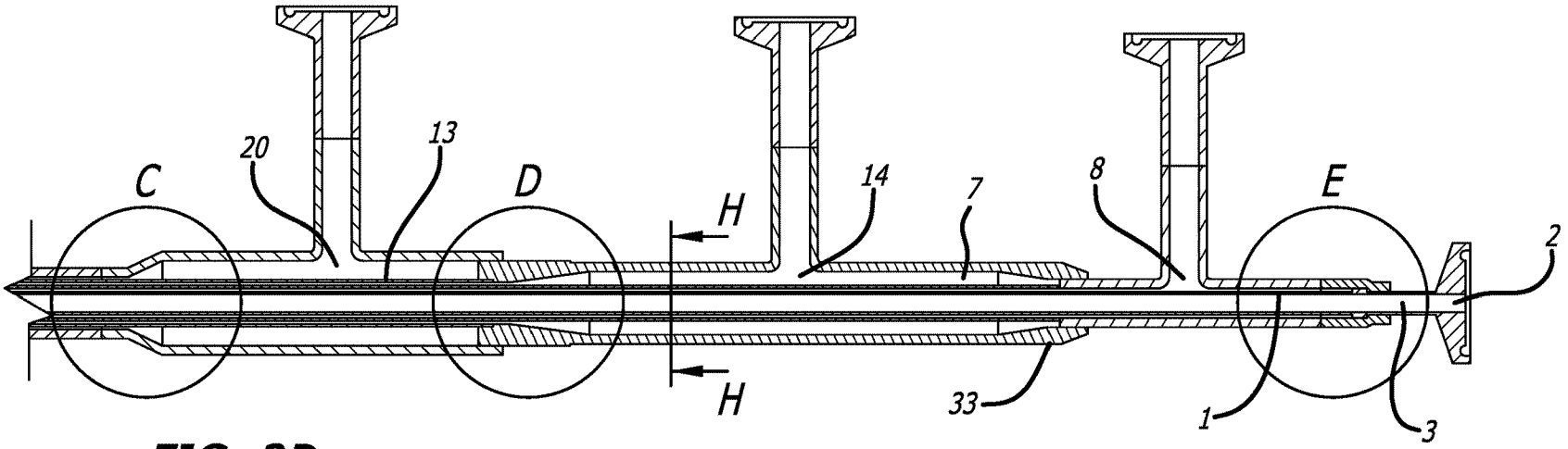
FIG. 2D Section A-A

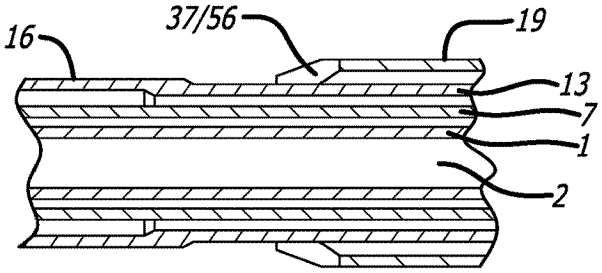
FIG. 4 Detail B
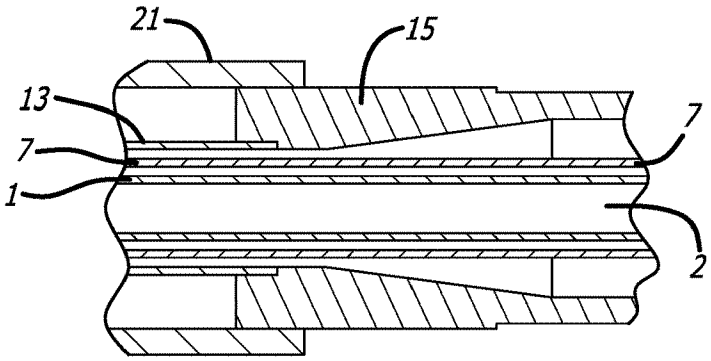
FIG. 6 Detail D
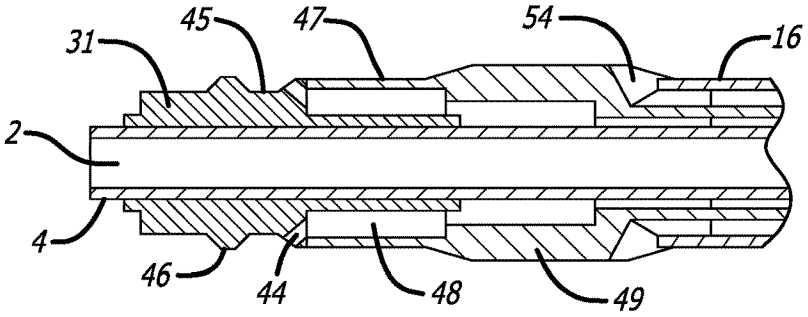
FIG. 3 Detail A
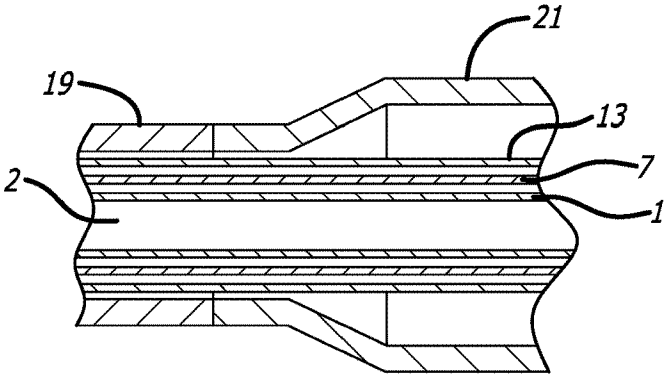
FIG. 5 Detail C
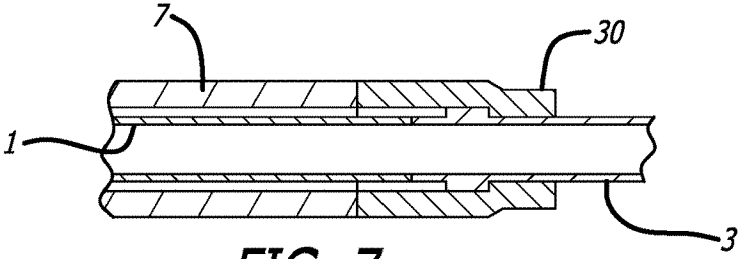
FIG. 7 Detail E

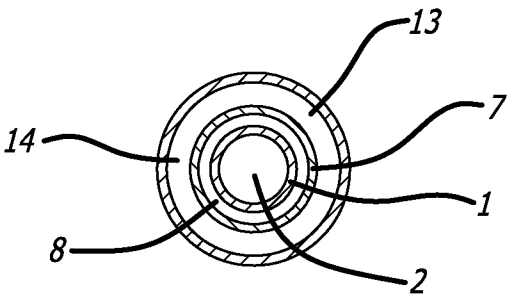
FIG. 9 Section G-G
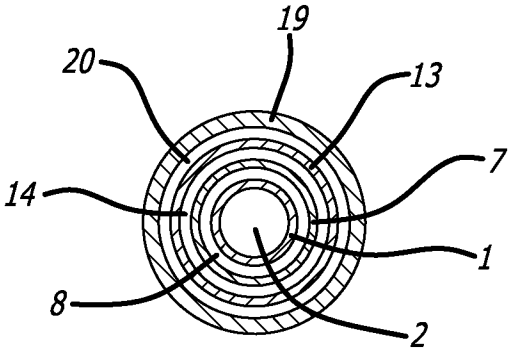
FIG. 8 Section F-F
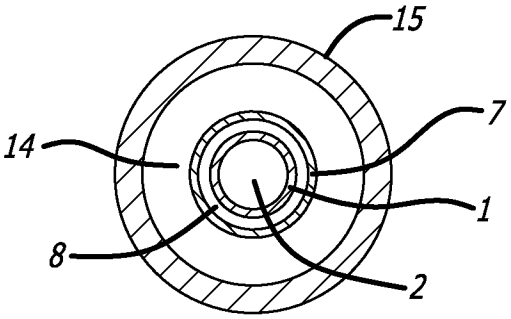
FIG. 10 Section H-H

STICK FILLER PIPE WITH INTEGRAL STERILIZATION

CROSS-REFERENCE TO RELATED APPLICATION

This application claims priority under 35 U.S.C. § 119 to NL Patent Application No. 2021787, filed Oct. 10, 2018, the entirety of which is hereby incorporated by reference.

BACKGROUND

The invention relates to a sterilizer-filler nozzle assembly for an aseptic packaging machine, in particular of a type that comprises a form section that defines an outer wall with a proximal and a distal end, which outer wall is designed to form a packaging tube out of a web-shaped packaging material around the wall while the packaging tube moves downstream and while the packaging tube gets sealed along a longitudinal edge.

Such sterilizer-filler nozzle assemblies for example can be used for aseptically packaging quantities of sterile products, like liquid food products, in sterile sealed packaging tubes, for example sticks. With this the packaging material gets sterilized before the packaging tube gets filled with the sterile product.

This sterilization for example can be done by guiding the web-shaped material through a bath filled with sterilization medium and then have the thus wetted packaging material run through the sterile zone of the aseptic packaging machine towards the form section. See for example U.S. Pat. No. 4,055,035. A disadvantage hereof was that the relatively large sterile zone of such machine needed to be made and kept sterile during the entire packaging process.

From WO 2017/220688 it is known to have the sterilization of the packaging material take place after the forming of the packaging tube. Thus a lot of equipment of the packaging machine no longer had to be kept in a sterile environment. For being able to perform the sterilization inside the packaging tube, a sterilizer-filler nozzle assembly is provided that comprises a central product dispensing pipe that is partly surrounded by a cylindrical plasma mist dispensing pipe that has an open end adjacent an open end of the dispensing packaging tube. The plasma mist dispensing pipe provides a tapered or stepped construction to a forming pipe about which the packaging material is folded into its packaging tube-shape and is sealed along a longitudinal edge. Cold plasma mist gets dispensed to flow along and sterilize the packaging material right after it has been formed in the packaging tube-shape and just before it comes into contact with the sterile product. The plasma mist dispensing pipe is partly surrounded by the forming pipe that has an open end adjacent the open end of the plasma mist dispensing pipe. The forming pipe here serves the purpose of inlet pipe for extraction of the plasma mist out of the formed packaging tube again.

A disadvantage with this is that the sterilizing leaves to be improved. For example the sterilizing of the inner side of the packaging material packaging tube with the cold plasma mist has an uncertain outcome. It is not proven technology yet. Another disadvantage is that the dispensed plasma mist may deteriorate the quality of the product. Yet another disadvantage is that it is not possible to replace the cold plasma mist for an already approved type of sterilization medium like a heated Hydrogen Peroxide Vapor (HPV). Firstly, the high temperature of the sterilization medium then could lead to the product getting overheated.

Secondly, the concentration of hydrogen peroxide that then may enter into the product as a result of the sterilization may well become larger than a maximum amount as is defined by law.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

The present invention aims to at least partly overcome those disadvantages or to provide a usable alternative. In particular the invention aims to provide an improved sterilizer-filler nozzle assembly with which sterile products can be aseptically packaged in sterilized packaging tube-shaped packages at high speed, in an efficient and economic manner while at a same time being able to maintain a high quality for the packaged product.

This aim is achieved by means of the sterilizer-filler nozzle assembly for an aseptic packaging machine according to claim 1. This nozzle assembly comprises:

- a form section that has an outer wall, a proximal end and a distal end, which outer wall is designed to form a packaging tube out of a web-shaped packaging material around the outer wall while the packaging tube moves downstream and while the packaging tube gets sealed along a longitudinal edge;
- a product supply duct that extends at least partly through the form section;
- has a product inlet connector which lies upstream of the distal end of the form section; and
- has a product outlet portion which lies downstream of the distal end of the form section;
- a sterilization medium supply duct that extends at least partly through the form section;
- has a sterilization medium inlet connector which lies upstream of the distal end of the form section; and
- has a sterilization medium outlet portion which lies between the distal end of the form section and the product outlet portion;
- an exhaust duct that extends at least partly through the form section;
- has an exhaust outlet connector which lies upstream of the distal end of the form section; and
- has an exhaust inlet portion which lies between the distal end of the form section and the product outlet portion; and
- a gas supply duct that extends at least partly through the form section;
- has a gas inlet connector which lies upstream of the distal end of the form section; and
- has a gas outlet portion which lies between the sterilization medium outlet portion and the product outlet portion.

Thus according to the invention a product supply duct, a gas supply duct, a sterilization medium supply duct, and an exhaust duct all run at least partly through a form section while having their distal outlet and inlet portions all positioned to be able to project into a packaging tube of packaging material right after it has been formed around said form section. This for the first time makes it possible to truly efficiently sterilize the interior of the formed packaging tube directly after it has been formed and just before the thus sterilized packaging tube gets filled with sterile product. By equipping the nozzle assembly with not only the product supply duct, sterilization medium supply duct and exhaust duct, but also with the gas supply duct while having the gas outlet portion thereof opening out inside the packaging tube at a position in between where the product outlet portion and the sterilization medium outlet portion open out inside the packaging tube, a number of important advantages can be obtained.

Firstly, the invention makes it possible to keep a zone where the actual sterilizing and filling take place as compact as possible, and more importantly fully within the already formed packaging tube. In this way it can be truly guaranteed that after the sterilizing of the packaging tube's interior has taken place, no new contaminations can enter the aseptic packaging process. An aseptic zone is thus created that cannot be breached from the outside.

Furthermore the sterilization of the packaging tube's interior can be truly optimized. The combination of (1) injecting a sterilization medium and (2) injecting a gas directly into the packaging tube's interior, and (3) having both of them actively drained also directly out of the packaging tube's interior, in practice has proven to be able to have the packaging tube sterilized to a very high level. An aseptic packaging machine that gets equipped with this new and inventive nozzle assembly in practice has proven to be able to run at high speed while still obtaining a high level of sterilization and while being able to maintain a high quality for the packaged product.

The injection of the gas at the position in between the injection of the sterilization medium and the injection of the product inside the packaging tube, causes the injected gas to form a physical barrier between the product and the sterilization medium. Owing to this the sterilization medium cannot come into direct contact with the product. Thus the sterilization medium is prevented from entering into the product or transferring heat thereto. This means that the quality of the product can be kept high, and that no breakdown of specific molecules, like vitamins and proteins, inside the product will take place because of the sterilization medium and process. Also no loss of flavor of the product has to take place because of the sterilization medium and process.

The invention also makes it possible to use all kinds of sterilization media, like liquids or vapors, in particular ones that have already well proven themselves in terms of sterilization performances, like for example hot Hydrogen Peroxide Vapor (HPV), without running the risk that the sterilization medium may enter into or negatively influence the product as a result of the sterilization. This in turn makes it possible to keep a concentration of sterilization medium, like hydrogen peroxide, that may enter the product as a result of the packaging sterilization, well below a maximum amount that is defined by law.

It also makes it possible to use heated sterilization media. In particular, the sterilization media may now even be heated above a temperature that otherwise could be harmful for the sterile product when in direct or indirect contact therewith.

Finally, the combined injection of the sterilization medium and gas into the packaging tube's interior may help to quickly and efficiently dry the inside of the packaging tube after it has been sterilized with sterilization medium. This helps to further prevent that the sterilization medium may indirectly enter into the product via the packaging tube's interior walls when they move forward downstream, and thus helps to keep the quality of the product at a maximum while also complying with various law regulations, like ones of the FDA.

The sterilization medium can be of all kinds, but preferably can be of a type that needs to get heated to a temperature of at least 45 degrees Celsius in order to be able to fulfil the sterilizing requirements. In particular the injected sterilization medium can be formed by the already mentioned Hydrogen Peroxide Vapor (HPV), which is obtained from a heated solution of liquid H2O2 and water.

The gas can be of all kinds, but preferably can be of a type that is sterile and/or inert to the product. In particular the injected gas can be formed by sterile air. The injected gas can also be formed by nitrogen. With this the gas may get heated or not before getting injected.

The product can be of all kinds, but preferably can be of a type that is destined for consumption. In particular the product can be formed by a food product, more particularly a liquid food product. The product can also be of a type that is destined for the pharmaceutical industry. In particular the product can then be formed by a medicine, more particularly a liquid medicine.

The packaging material can be of all kinds, but preferably can be a film or of a laminated material.

In a preferred embodiment the gas outlet portion may come to lie upstream adjacent the product outlet portion, while having the sterilization medium outlet portion and the exhaust inlet portion lying further upstream thereof. Thus the injected gas gets to first form a protective gas barrier directly on top of the product interface and then flow away from this product interface in the direction of the upstream positioned sterilization medium outlet portion and exhaust inlet portion. Furthermore the injected gas then is able to dry the inner wall of the formed packaging tube at a position downstream of where it may have been in contact with the sterilization medium.

In a first variant hereof the sterilization medium outlet portion then may lie upstream adjacent the gas outlet portion, while the exhaust inlet portion then may lie upstream adjacent the sterilization medium outlet portion. This may bring the advantage that the injected gas that flows in the direction of the upstream exhaust inlet portion can help to quickly and efficiently have the injected sterilization medium transported towards the exhaust inlet portion and from there out of the packaging tube via the exhaust duct. This may make it possible to speed up the sterilizing-filling process.

In a second variant hereof the exhaust inlet portion then may lie upstream adjacent the gas outlet portion, while the sterilization medium outlet portion then may lie upstream adjacent the exhaust inlet portion. This may bring the advantage that the injected gas that flows in the direction of the upstream exhaust inlet portion can more easily perform a drying function, because a large amount of the further upstream injected sterilization medium then already may have gotten drained into the exhaust inlet portion and out of the packaging tube via the exhaust duct. This also may make it possible to speed up the sterilizing-filling process.

In an embodiment the gas outlet portion may envelop a part of the product supply duct and comprise a plurality of gas outlet holes around its circumference that each connect to the gas supply duct. This may help to obtain a good distribution of the injected gas inside the formed packaging tube.

Furthermore, the gas outlet holes then may be directed inclined forward. This may help to build up a suitable pressure for the protective gas barrier such that the injected sterilization medium cannot start to flow passed by it.

In addition hereto or in the alternative the gas outlet portion may comprise a circumferential gutter which lies downstream of the gas outlet holes and into which the gas outlet holes open out. The gas outlet portion then may further comprise a circumferential ridge which lies downstream of the circumferential gutter and that has a diameter that is larger than a diameter at which the gas outlet holes open out into the gutter. Thus it can be prevented that the injected product may enter into the gas outlet holes and starts blogging one or more of them. Furthermore, the ridge may help to guide the formed packaging tube with some circumferential play over the gas outlet holes.

In addition hereto or in the alternative the gas outlet portion may comprise an air-cushion section which lies upstream of the gas outlet holes, wherein the air-cushion section may have a diameter that is larger than a diameter at which the gas outlet holes open out. Injected gas can then be forced to flow along the air-cushion section when flowing towards the exhaust inlet portion. Those gases flowing alongside the air-cushion section shall somewhat lift the formed packaging tube up from the gas outlet portion and thus make it lighter for the formed packaging tube to move forward along the nozzle assembly. Also it shall help to dry the entire packaging tube interior because no wetted parts thereof then get to stick against the gas outlet portion. Another advantage is that the air-cushion section may form a downstream physical barrier between the sterilization zone and the product interface.

The air-cushion section may have a length of at least 15 mm. This has proven to be sufficient for obtaining the aimed barrier and drying result.

In addition hereto the air-cushion section may comprise a plurality of gas guiding grooves that extend downstream and away from the gas outlet holes towards the exhaust inlet portion. This may help to build up a substantially similar lifting pressure around the circumference in between the formed packaging tube and the air-cushion section and to keep the formed packaging tube well centered around the nozzle assembly.

In an embodiment the sterilization medium outlet portion may envelop a part of the gas supply duct or exhaust duct, and comprise a plurality of sterilization medium outlet holes around its circumference and/or along its length that each connect to the sterilization medium supply duct. This may help to obtain a good distribution of the injected sterilization medium inside the formed packaging tube.

Furthermore, the sterilization medium outlet portion may comprise a sterilization zone which lies downstream of the air-cushion section and which has a diameter that is smaller than the diameter of the air-cushion section. This may help to minimize a risk of the formed packaging tube starting to stick locally against the sterilization zone.

The sterilization zone may have a length of at least 50 mm. This has proven to be sufficient for obtaining the aimed sterilization result.

In an embodiment the exhaust inlet portion may envelop a part of the gas supply duct or sterilization medium supply duct, and comprise a plurality of exhaust inlet holes around its circumference that each connect to the exhaust duct. This may help to obtain a good draining of the injected sterilization medium and gas inside the formed packaging tube.

The form section, the product outlet portion, the gas outlet portion, the sterilization medium outlet portion and the exhaust inlet portion may all extend in a same axial direction.

During production, the formed packaging tube, when leaving the form section where it has been formed and sealed, then may be forced to move downstream in that axial direction along the product outlet portion, the gas outlet portion, the sterilization medium outlet portion and the exhaust inlet portion. This makes a compact assembly possible.

Furthermore, the form section, the product outlet portion, the gas outlet portion, the sterilization medium outlet portion and the exhaust inlet portion then may all extend in a same vertical direction. This makes it possible to optimally profit from gravitational forces.

In an embodiment the form section, the product outlet portion, the gas outlet portion, the sterilization medium outlet portion and the exhaust inlet portion may all be positioned coaxial relative to each other at differing positions along a common axial direction of the form section, the product outlet portion, the gas outlet portion, the sterilization medium outlet portion and the exhaust inlet portion. Thus, those portions of the nozzle assembly can be kept compact and rotation symmetric.

Furthermore, at least parts of the product supply duct, the gas supply duct, the sterilization medium supply duct and the exhaust duct can then be delimited by first, second, third and fourth pipes that envelop each other over parts of their lengths while leaving free their distal outlet and inlet portions.

In addition hereto the fourth pipe may define the outer wall of the form section. Thus the nozzle assembly can be made economic. It is not necessary to provide a distinctive fifth pipe or the like for the form section.

In addition hereto or in the alternative the first pipe may lie in the center of the assembly while delimiting the product supply duct, whereas the second pipe then may envelop part of the length of the first pipe while delimiting the gas supply duct there between, whereas the third pipe then may envelop part of the length of the second pipe while delimiting the sterilization medium supply duct or the exhaust duct there between, and whereas the fourth pipe then may envelop part of the length of the third pipe while delimiting the other one of the sterilization medium supply duct and the exhaust duct there between. Owing to this relative positioning it is advantageously achieved that the gas supply duct and the second pipe delimiting it may form an isolating buffer between the product supply duct and the sterilization medium supply duct. This in turn makes it possible to use sterilization medium of a type that needs to get heated to a temperature that could otherwise be harmful for the sterile product.

Further preferred embodiments are stated in the subclaims.

The invention also relates to an aseptic filling machine and to a method for using it.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein:

The invention shall be explained in more detail below with reference to the accompanying drawings, in which:

FIGS. 1*a*, 1*b*, and 1*c* show a perspective view and enlarged partial views of an embodiment of a sterilizer-filler nozzle assembly according to the invention;

FIGS. 2*a*, 2*b*, 2*c*, and 2*d* show a front view and a longitudinal sectional view over the line A of the distal end of FIG. 1*b* and the proximal end of FIG. 1*c;*

FIGS. 3-7 show an enlarged partial views of the details A-E in FIGS. 2*a*, 2*b*, 2*c*, and 2*d;*

FIGS. 8-10 show cross-sectional views over the lines F-H in FIGS. 2*a*, 2*b*, 2*c*, and 2*d;*

DETAILED DESCRIPTION

Figure 2A:
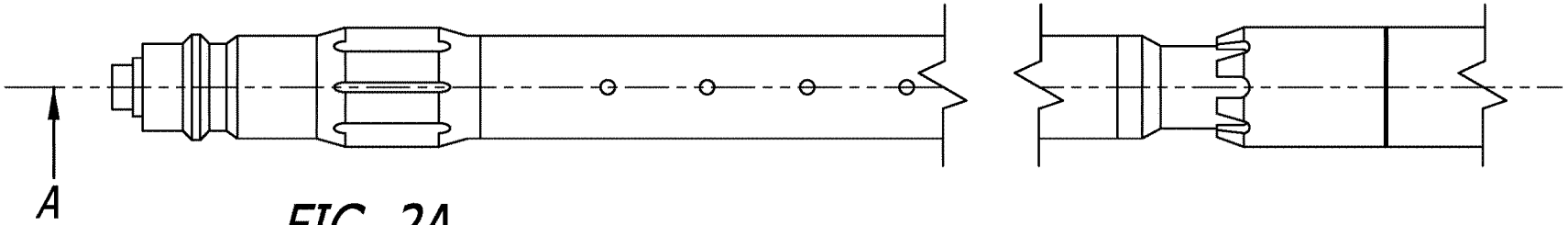
Figure 2B:
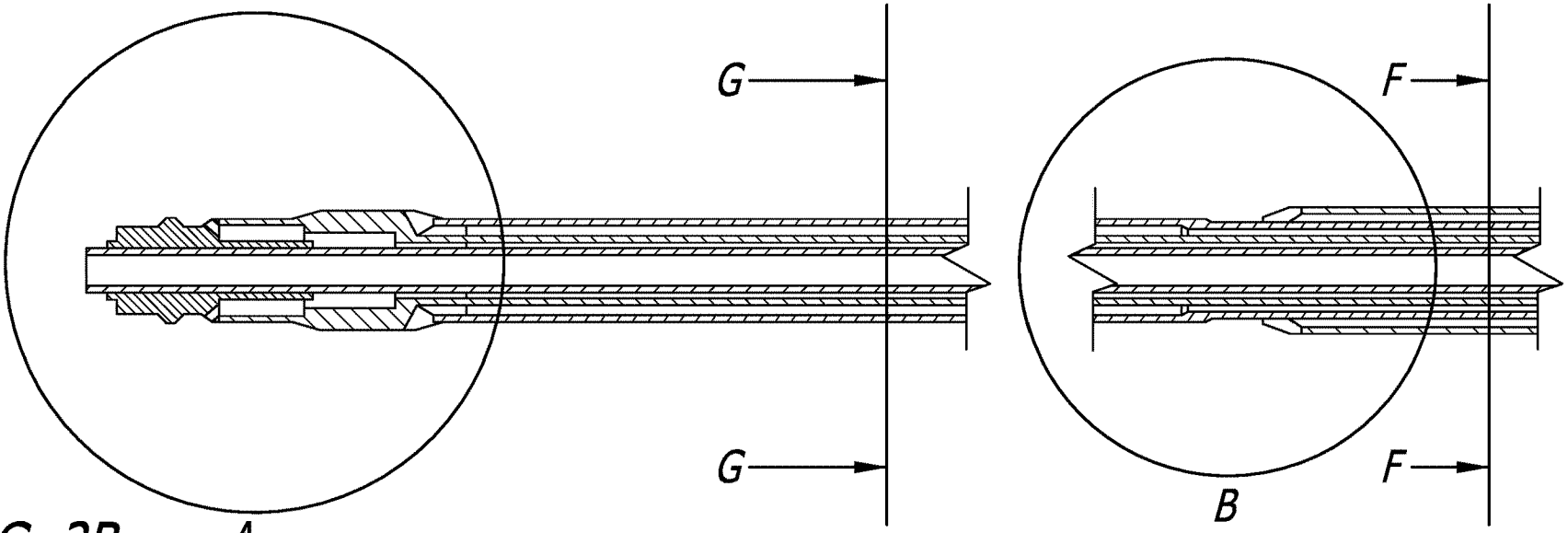

In FIGS. 1*a*-10 the sterilizer-filler nozzle assembly comprises a first pipe that has been indicated with the reference numeral 1. A product supply duct 2 is delimited by the first pipe 1. The first pipe 1 extends along an axial direction y and has a central axis. A product inlet connector 3 is provided at a proximal end of the first pipe 1. A product outlet portion 4 is provided at a distal end of the first pipe 1.

The first pipe 1 is enveloped over an intermediate part, that lies in between its product inlet connector 3 and its product outlet portion 4, by a second pipe 7. A gas supply duct 8 is delimited in between the first and second pipe 1, 7. The second pipe 7 also extends along the axial direction y and has the same central axis as the first pipe 1. A gas inlet connector 9 is provided at a proximal end of the second pipe 7. A gas outlet portion 10 is provided at a distal end of the second pipe 7.

The second pipe 7 is enveloped over an intermediate part, that lies in between its gas inlet connector 9 and its gas outlet portion 10, by a third pipe 13. A sterilization medium supply duct 14 is delimited in between the second and third pipe 7, 13. The third pipe 13 also extends along the axial direction y and has the same central axis as the first and second pipe 1, 7. A sterilization medium inlet connector 15 is provided at a proximal end of the third pipe 13. A sterilization medium outlet portion 16 is formed by a distal end of the third pipe 13.

The third pipe 13 is enveloped over an intermediate part, that lies in between its sterilization medium inlet connector 15 and its sterilization medium outlet portion 16, by a fourth pipe 19. An exhaust duct 20 is delimited in between the third and fourth pipe 13, 19.

The fourth pipe 19 also extends along the axial direction y and has the same central axis as the first, second and third pipe 1, 7, 13. An exhaust outlet connector 21 is provided at a proximal end of the fourth pipe 19. An exhaust inlet portion 22 is provided at a distal end of the second pipe 7.

The product inlet connector 3, the gas inlet connector 9, the sterilization medium inlet connector 15 and the exhaust outlet connector 21 are each provided with a connection flange 24-27 for connecting them respectively to a pressurized product supply feed, a pressurized gas supply feed, a pressurized sterilization medium supply feed and a vacuum exhaust drain of an aseptic packaging machine.

The gas inlet connector 9, the sterilization medium inlet connector 15 and the exhaust outlet connector 21 each have their connection flanges 24-27 provided at sideways projecting connector parts 9', 15', 21'.

The second pipe 7 is kept centered around the first pipe 1 while leaving free the gas supply duct 8 between them, by means of the gas inlet connector 9 resting with a radially inwardly projecting side wall 30 upon an outer circumferential wall part of the product inlet connector 3 (see FIG. 7), as well as by means of the gas outlet portion 10 resting with a radially inwardly projecting side wall 31 upon an outer circumferential wall part of the product outlet portion 4 (see FIG. 3).

The third pipe 13 is kept centered around the second pipe 7 while leaving free the sterilization medium supply duct 14 between them, by means of the sterilization medium inlet connector 15 resting with a radially inwardly projecting side wall 33 upon an outer circumferential wall part of the gas inlet connector 9 (see FIGS. 2*a*, 2*b*, 2*c*, and 2*d*), as well as by means of a distal end of the sterilization medium outlet portion 16 being fixedly connected to a proximal end of the gas outlet portion 10 (see FIG. 3).

The fourth pipe 19 is kept centered around the third pipe 13 while leaving free the exhaust duct 20 between them, by means of the exhaust outlet connector 21 resting with a proximal end upon a distal end of an outer circumferential wall part of the sterilization medium inlet connector 15 (see FIG. 6), as well as by means of the exhaust inlet portion 22 resting with a radially inwardly projecting side wall 37 upon an outer circumferential wall part of the third pipe 13 adjacent a proximal end part of the sterilization medium outlet portion 16 (see FIG. 4).

The outer cylindrical wall of the fourth pipe 19 provides a form section 40 (see FIGS. 2*a*, 2*b*, 2*c*, and 2*d*, 4, and 5). During operation a packaging tube out of a web-shaped packaging material is formed around this wall while having the formed packaging tube move downstream, in the axial direction y from a proximal end of the form section 40 where the forming of the packaging tube starts towards a distal end of the form section 40 where the forming of the packaging tube is completed. During the packaging tube-forming process around the form section 40, abutting longitudinal edge parts of the web-shaped packaging material get sealed to each other, for example thermo-sealed by means of a sealer of the packaging machine that is positioned sideways of the form section. The thus formed and sealed longitudinal edge is also referred to as a fin seal. During this forming of the web-shaped packaging material into the tube-shape, a driving force gets exerted onto the packaging material for moving it downstream along the nozzle assembly. This can be done intermittently or continuously at a constant speed.

The product outlet portion 4 here is formed by a cylindrical distal end part of the first pipe 1. The gas outlet portion 10 lies upstream adjacent the product outlet portion 4. The gas outlet portion 10 comprises a plurality of gas outlet holes 44 around its circumference that are directed inclined forward. In front of the gas outlet holes 44 a circumferential gutter 45 is provided. In front of the gutter 45 a circumferential ridge 46 is provided. Behind the gas outlet holes 44 a cylindrical section 47 is provided that delimits a gas supply chamber 48 that connects the gas supply duct 2 to the gas outlet holes 44. Behind the cylindrical section 47 an air-cushion section 49 is provided. The air-cushion section 49 has a larger diameter than the cylindrical section 47 that in turn has substantially the same diameter as the one at which the gas outlet holes 44 open out. The air-cushion section 49 comprises a plurality of gas guiding grooves 50 (see FIG. 1) that extend in the axial direction y.

The sterilization medium outlet portion 16 lies upstream adjacent the gas outlet portion 10 and provides a cylindrical sterilization zone along which a plurality of primary sterilization medium outlet holes 53 are provided that connect to the sterilization medium supply duct 14. The cylindrical sterilization zone has a diameter that is smaller than the diameter of the air-cushion section 49. The sterilization medium supply duct 14 also connects to a plurality of secondary sterilization medium outlet holes 54 that are provided around a circumference of a proximal end of the air-cushion section 49 while opening out inside proximal ends of the grooves 50 that are provided therein. Both the primary sterilization medium outlet holes 53 as well as the secondary sterilization medium outlet holes 54 are directed radially outward.

The exhaust inlet portion 22 lies upstream adjacent the sterilization medium outlet portion 16 and comprises a plurality of exhaust inlet holes 56 around its circumference that each connect to the exhaust duct 20.

Figure 11:
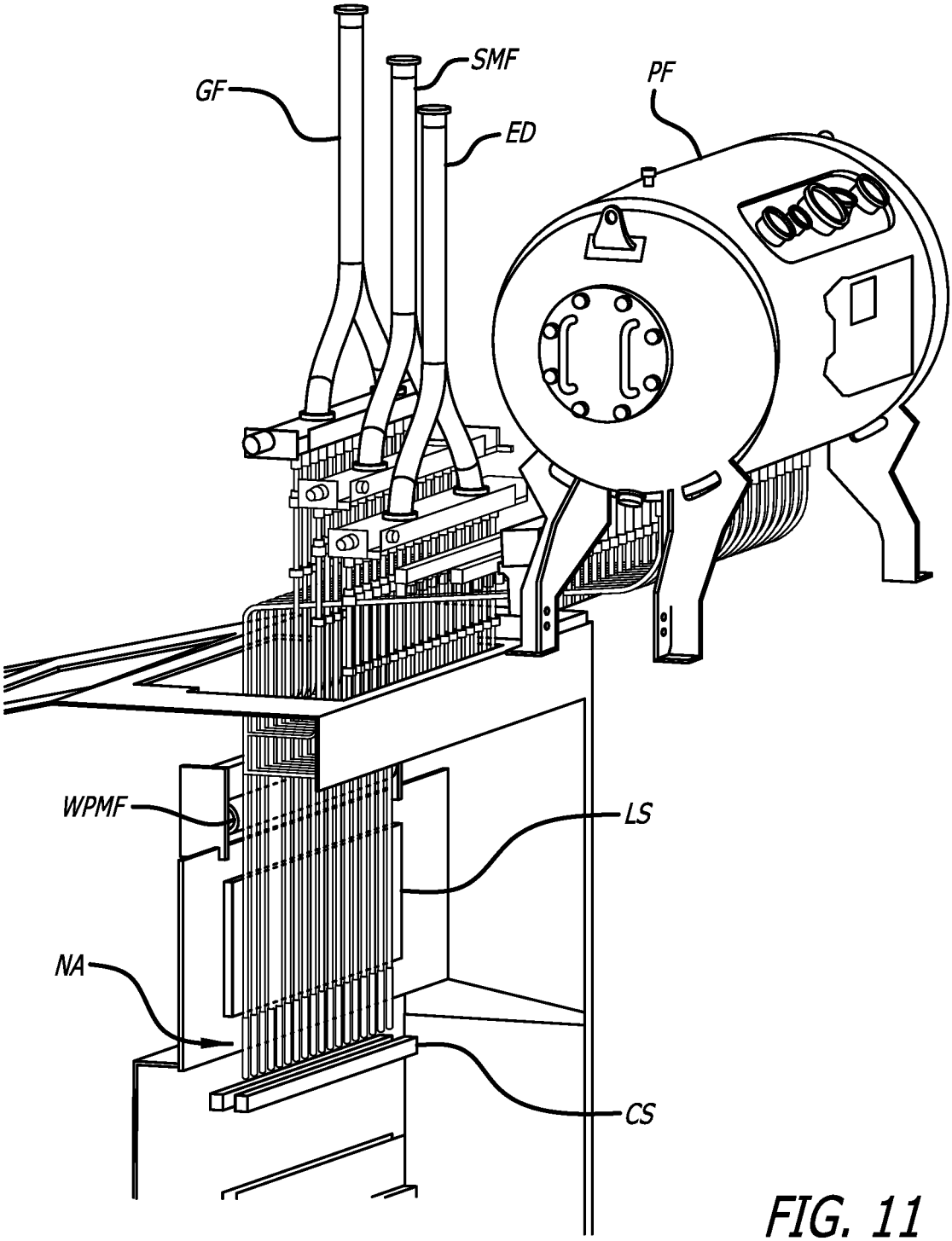
FIG. 11 shows an aseptic packaging machine including a plurality of the nozzle assemblies.

FIG. 11 shows an aseptic packaging machine that is equipped with a number of the nozzle assemblies NA, that are positioned next to each other. For each nozzle assembly NA, the machine comprises web-shaped packaging material feeds WPMF, for example wound around reels, from where webs of the packaging material can get guided towards the respective form sections. The machine further comprises a product supply feed PF, for example a tank, that is filled with sterile product and that is connectable via hoses, pipes or the like, to the product inlet connectors. The machine also comprises a sterilization medium supply feed SMF, for example leading to a tank, that is filled with sterilization medium and that is connectable via hoses, pipes or the like, to the sterilization medium inlet connectors. The machine furthermore comprises a gas supply feed GF, for example leading to a compressor, that is connectable via hoses, pipes or the like, to the gas inlet connectors. And the machine comprises an exhaust drain ED, that is used to subtract sterilization medium and sterile gas, and for example exhaust it to the environment and that is connectable via hoses, pipes or the like, to the exhaust outlet connectors.

At a position sideways of the form sections, a longitudinal sealer LS is provided that is designed to continuously make fin seals to the packaging tubes, for example by having their opposing longitudinal edges getting continuously guided along or through heated portions of the sealer LS for connecting them with each other.

At a position downstream of the nozzle assemblies, a cross-sealer CS is provided that is designed to make cross seals into filled sections of the packaging tubes, for example by having two heated portions of operable press jaws that are positioned at opposing sides of the filled packaging tubes getting pressed towards each other for connecting opposing wall sections of the filled packaging tubes with each other.

Before operation starts, the product outlet portion 4, the gas outlet portion 10, the sterilization medium outlet portion 16, and the exhaust inlet portion 22, get pre-sterilized. This can be done in various ways, for example with or without the formed packaging tube of packaging material already around them.

Figure 12:
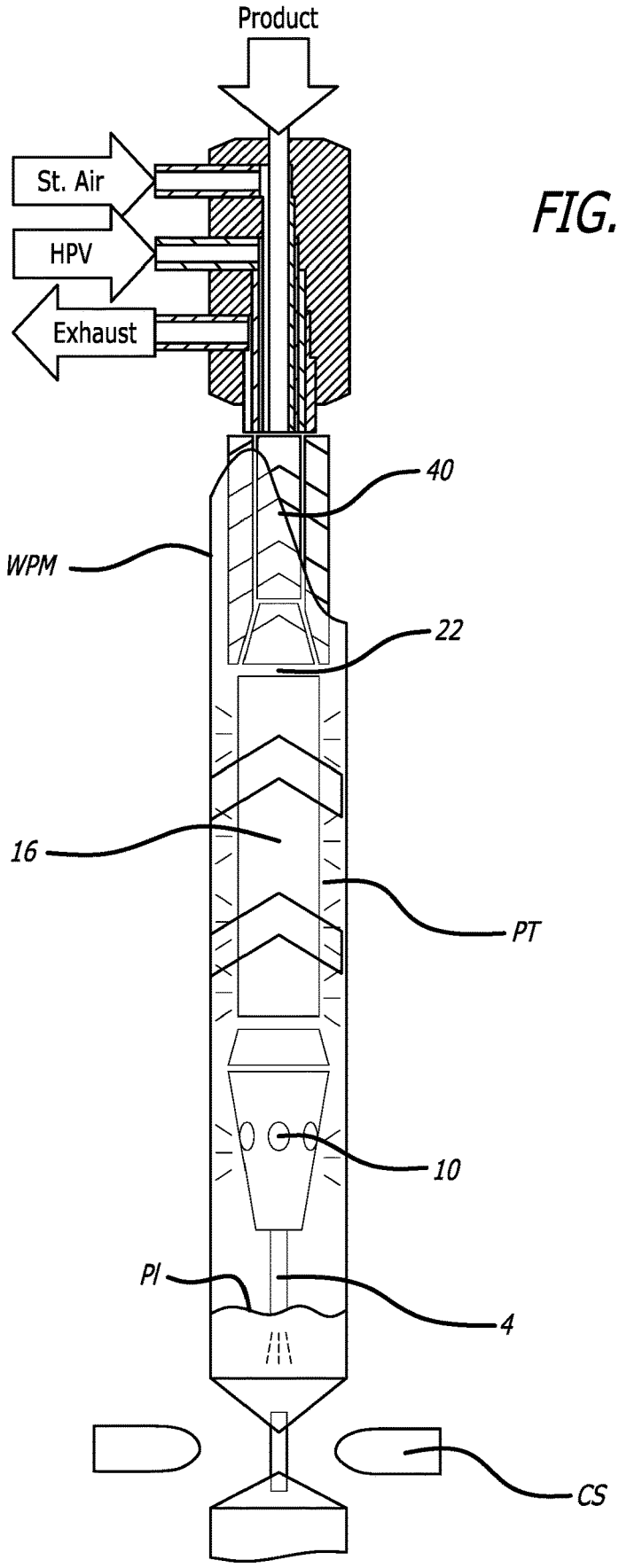
FIG. 12 schematically shows the sterilizing-filling process during production with the nozzle assembly of FIG. 1.

After the pre-sterilization has been completed, the actual sterilizing-filling process of the packaging tube can be (re)started. This is shown in FIG. 12. Web-shaped packaging material WPM is fed towards the form section 40 and there formed into the packaging tube PT, while having its fin seal formed. Pressurized sterile product starts flowing through the product supply duct and via the outlet opening in the product outlet portion 4 into the packaging tube PT. At a same time pressurized sterile gas (air) starts flowing through the gas supply duct 8 and via the outlet holes in the gas outlet portion 10 into the packaging tube PT at a position above a product interface PI, and pressurized sterilization medium starts flowing through the sterilization medium supply duct and via the outlet holes in the sterilization medium outlet portion 16 into the packaging tube PT at the position above the gas outlet holes. Simultaneously, a vacuum force gets exerted through the exhaust duct and via the exhaust inlet holes in the exhaust inlet portion 22 to the packaging tube's interior at a position above the sterilization medium outlet holes such that used sterilization medium and gas get drained away.

The pressures of the product, gas and sterilization medium, as well as the vacuum force, get tuned relative to each other in such a way that the injected product forms the product interface PI that lies downstream of the gas outlet holes 44, while at a same time the injected gas forms a gas barrier on top of the product interface PI, while overflow of injected gas flows towards the exhaust inlet holes 37 while drying the packaging tube's interior wall and while taking along the injected sterilization medium to also flow towards the exhaust inlet holes 37 while sterilizing the packaging tube's interior walls.

Figure 13B:
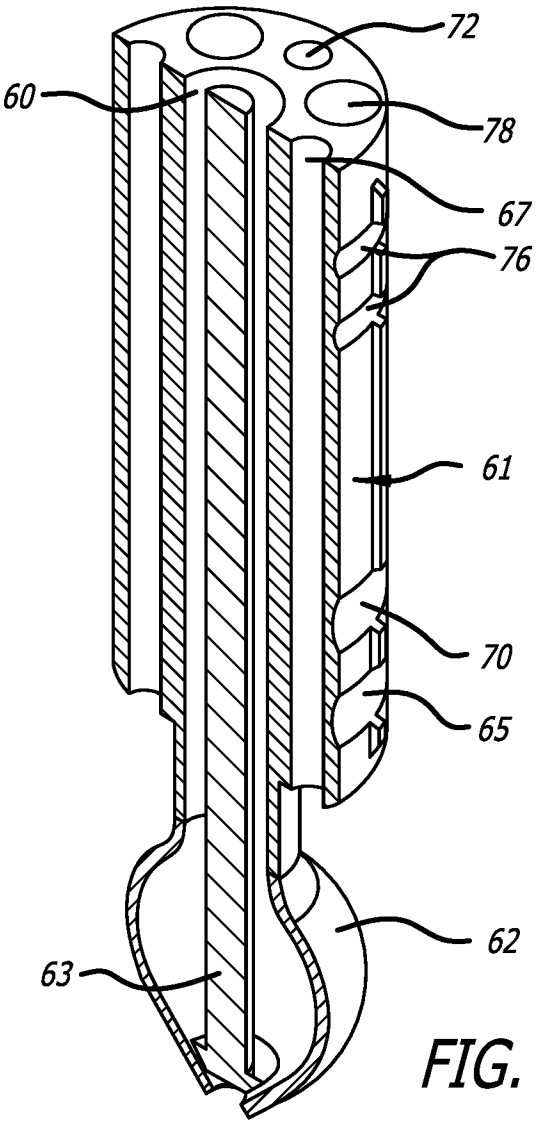
FIGS. 13*a*, 13*b* show a schematic perspective and a cross sectional view of another embodiment of a sterilizer-filler nozzle assembly according to the invention.
Figure 13A:
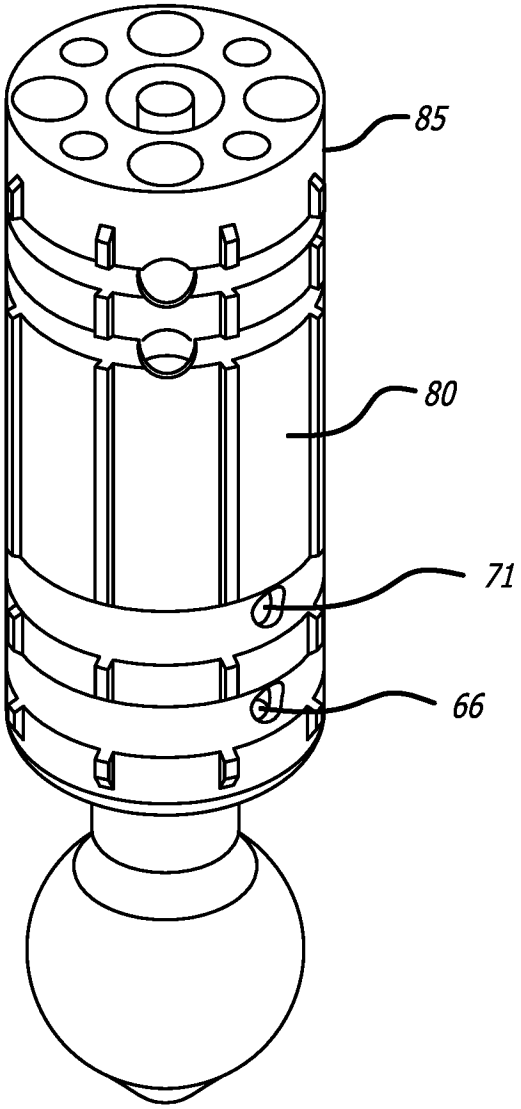

In FIGS. 13*a* and 13*b*, a variant is shown in which a product supply duct 60 is delimited in a center of a thick walled cylindrical housing 61 that at its lower end terminates into a droplet-shaped product outlet portion 62. Inside the product supply duct 60 an operable valve 63 is provided.

Upstream adjacent the product outlet portion 62 a gas outlet portion is provided. This gas outlet portion comprises a circumferential gutter 65 inside which gas outlet holes 66 are provided that connect to gas supply ducts 67 that extend in the axial direction through the housing 61 parallel to the product supply duct 60.

Upstream adjacent the gas outlet portion an exhaust inlet portion is provided. This exhaust inlet portion comprises a circumferential gutter 70 inside which exhaust inlet holes 71 are provided that connect to exhaust ducts 72 that extend in the axial direction through the housing 61 parallel to the product supply duct 60.

Upstream adjacent the exhaust inlet portion a sterilization medium outlet portion is provided. This sterilization medium outlet portion comprises two spaced circumferential gutters 76 inside which sterilization medium outlet holes 77 are provided that connect to sterilization medium supply ducts 78 that extend in the axial direction through the housing 61 parallel to the product supply duct 60.

The cylindrical housing 61 is provided with guiding grooves 80 that extend in the axial direction between the respective gutters 65, 71, 76. Those grooves serve the purpose of having gas that gets injected via the gas outlet holes 66 as well as sterilization medium that gets injected via the sterilization medium outlet holes 77 perform an air-cushioning effect onto a formed packaging tube that gets moved downwards along the housing 61.

A form section 85 is provided along an upper part of the cylindrical housing 61 (of which form section merely a lower distal part is shown).

During operation, in this embodiment also, pressurized sterile product may start flowing through the product supply duct 60 and via the product outlet portion 62 into a packaging tube immediately after this packaging tube has been formed around the form section 85. At a same time pressurized sterile gas may start flowing through the gas supply ducts 67 and via the gas outlet holes 66 into the packaging tube at a position above the product interface, and pressurized sterilization medium may start flowing through the sterilization medium supply ducts 78 and via the sterilization medium outlet holes 77 into the packaging tube at the position above the gas outlet holes 66. Simultaneously, a vacuum force gets exerted to the packaging tube's interior via the exhaust inlet holes 71 at a position in between the gas outlet holes 66 and the sterilization medium outlet holes 77.

The pressures of the product, gas and sterilization medium, as well as the vacuum force, now get tuned relative to each other in such a way that the injected product forms a product interface that lies downstream of the gas outlet holes 66, while at a same time the injected gas forms a gas barrier on top of the product interface, while overflow of injected gas flows upwards towards the exhaust inlet holes while drying the wetted packaging tube's interior wall and while the injected sterilization medium flows downwards towards the exhaust inlet holes while sterilizing the packaging tube's interior walls.

Besides the embodiments shown numerous variants are possible. For example the shape, dimensions and choice of materials of the respective parts of the nozzle assembly may be changed.

Thus according to the invention sterilizer-filler nozzle assemblies are provided with which new but, if desired also already existing aseptic packaging machines can easily and quickly be equipped.

While illustrative embodiments have been illustrated and described, it will be appreciated that various changes can be made therein without departing from the spirit and scope of the invention.

The embodiments of the invention in which an exclusive property or privilege is claimed are defined as follows:

1. A sterilizer-filler nozzle assembly for an aseptic packaging machine, which assembly comprises:

(a) a form section that has an outer wall, a proximal and a distal end, which outer wall is designed to form a packaging tube out of a web-shaped packaging material around the outer wall while the packaging tube moves downstream and while the packaging tube gets sealed along a longitudinal edge;

(b) a product supply duct that:
extends at least partly through the form section;
has a product inlet connector which lies upstream of the distal end of the form section; and
has a product outlet portion which lies downstream of the distal end of the form section;

(c) a sterilization medium supply duct that:
extends at least partly through the form section;
has a sterilization medium inlet connector which lies upstream of the distal end of the form section; and
has a sterilization medium outlet portion which lies between the distal end of the form section and the product outlet portion;

(d) an exhaust duct that:
extends at least partly through the form section;
has an exhaust outlet connector which lies upstream of the distal end of the form section; and
has an exhaust inlet portion which lies between the distal end of the form section and the product outlet portion; and (e) a gas supply duct that:
extends at least partly through the form section;
has a gas inlet connector which lies upstream of the distal end of the form section; and
has a gas outlet portion which lies between the sterilization medium outlet portion and the product outlet portion.

2. The assembly according to claim 1, wherein the gas outlet portion lies upstream adjacent the product outlet portion.

3. The assembly according to claim 2, wherein the sterilization medium outlet portion lies upstream adjacent the gas outlet portion and wherein the exhaust inlet portion lies upstream adjacent the sterilization medium outlet portion.

4. The assembly according to claim 2, wherein the exhaust inlet portion lies upstream adjacent the gas outlet portion and wherein the sterilization medium outlet portion lies upstream adjacent the exhaust inlet portion.

5. The assembly according to claim 1, wherein the gas outlet portion envelops a part of the product supply duct and comprises a plurality of gas outlet holes around its circumference that each connect to the gas supply duct.

6. The assembly according to claim 5, wherein the gas outlet holes are directed inclined forward.

7. The assembly according to claim 5, wherein the gas outlet portion comprises a circumferential gutter which lies downstream of the gas outlet holes and into which the gas outlet holes open out, and wherein the gas outlet portion comprises a circumferential ridge which lies downstream of the circumferential gutter and that has a diameter that is larger than a diameter at which the gas outlet holes open out into the gutter.

8. The assembly according to claim 7, wherein the exhaust inlet portion envelops a part of the gas supply duct or sterilization medium supply duct, and comprises a plurality of exhaust inlet holes around its circumference that each connect to the exhaust duct.

9. The assembly according to claim 5, wherein the gas outlet portion comprises an air-cushion section which lies upstream of the gas outlet holes, wherein the air-cushion section has a diameter that is larger than a diameter at which the gas outlet holes open out.

10. The assembly according to claim 9, wherein the air-cushion section comprises a plurality of gas guiding grooves that extend away from the gas outlet holes towards the exhaust inlet portion.

11. The assembly according to claim 1, wherein the sterilization medium outlet portion envelops a part of the gas supply duct or exhaust duct, and comprises a plurality of sterilization medium outlet holes around its circumference and/or along its length that each connect to the sterilization medium supply duct.

12. The assembly according to claim 11, wherein the sterilization medium outlet portion comprises a sterilization zone which lies downstream of an air-cushion section and which has a diameter that is smaller than a diameter of the air-cushion section.

13. The assembly according to claim 1, wherein the exhaust inlet portion envelops a part of the gas supply duct or sterilization medium supply duct, and comprises a plurality of exhaust inlet holes around its circumference that each connect to the exhaust duct.

14. The assembly according to claim 13, wherein at least parts of the product supply duct, the gas supply duct, the sterilization medium supply duct and the exhaust duct are delimited by first, second, third and fourth pipes that envelop each other over parts of their lengths.

15. The assembly according to claim 14, wherein the fourth pipe defines the outer wall of the form section.

16. The assembly according to claim 14, wherein
the first pipe lies in a center of the assembly while delimiting the product supply duct;
the second pipe envelops part of the length of the first pipe while delimiting the gas supply duct therebetween;
the third pipe envelops part of the length of the second pipe while delimiting the sterilization medium supply duct or the exhaust duct therebetween; and
the fourth pipe envelops part of the length of the third pipe while delimiting the other one of the sterilization medium supply duct and the exhaust duct therebetween.

17. The assembly according to claim 1, wherein the form section, the product outlet portion, the gas outlet portion, the sterilization medium outlet portion and/or the exhaust inlet portion are coaxial relative to each other.

18. An aseptic packaging machine comprising:

one or more sterilizer-filler nozzle assemblies according to claim 1;

a web-shaped packaging material feed;

a product supply feed that is connectable to the product inlet connector;

a sterilization medium supply feed that is connectable to the sterilization medium inlet connector;

a gas supply feed that is connectable to the gas inlet connector; and an exhaust drain that is connectable to the exhaust outlet connector.

19. A method for using an aseptic packaging machine according to claim 18, comprising the steps of:

pre-sterilization of the product outlet portion, the gas outlet portion, the sterilization medium outlet portion, and the exhaust inlet portion;

forming of a packaging tube around the form section;

having sterile product flow through the product supply duct and via the product outlet portion into the packaging tube;

having sterile gas flow through the gas supply duct and via the gas outlet portion into the packaging tube at a position above the product outlet portion;

having sterilization medium flow through the sterilization medium supply duct and via the sterilization medium outlet portion into the packaging tube at a position above the gas outlet portion; and having a vacuum force exerted via the exhaust duct and via the exhaust inlet portion into the packaging tube at a position above the gas outlet portion.

* * * * *